US010959503B2

(12) United States Patent
Bilton et al.

(10) Patent No.: US 10,959,503 B2
(45) Date of Patent: Mar. 30, 2021

(54) FLUID DISPENSER

(71) Applicant: Conopco, Inc., Englewood Cliffs, NJ (US)

(72) Inventors: Simon Lewis Bilton, Warwick (GB); Timothy John Taylor Davies, Warwick (GB); Christopher John Jones, Warwick (GB)

(73) Assignee: Conopco, Inc., Englewood Cliffs, NJ (US)

( * ) Notice: Subject to any disclaimer, the term of this patent is extended or adjusted under 35 U.S.C. 154(b) by 235 days.

(21) Appl. No.: 16/304,971

(22) PCT Filed: May 23, 2017

(86) PCT No.: PCT/EP2017/062424
§ 371 (c)(1),
(2) Date: Nov. 27, 2018

(87) PCT Pub. No.: WO2017/211585
PCT Pub. Date: Dec. 14, 2017

(65) Prior Publication Data

US 2020/0324306 A1 Oct. 15, 2020

(30) Foreign Application Priority Data

Jun. 7, 2016 (EP) ..... 16173336

(51) Int. Cl.
*A45D 34/04* (2006.01)
*B05B 11/00* (2006.01)
*A45D 34/00* (2006.01)

(52) U.S. Cl.
CPC ..... *A45D 34/04* (2013.01); *B05B 11/0054* (2013.01); *B05B 11/3026* (2013.01);
(Continued)

(58) Field of Classification Search
CPC ..... A45D 34/04; A45D 2034/005; B05B 11/3026; B05B 11/0054; B05B 11/3052;
(Continued)

(56) References Cited

U.S. PATENT DOCUMENTS 3,949,906 A 4/1976 Pettersent et al.
4,238,055 A * 12/1980 Staar ..... B05B 11/3052 222/162

(Continued)

FOREIGN PATENT DOCUMENTS

CN 105246372 1/2016
CN 105618297 6/2016

(Continued)

OTHER PUBLICATIONS

IPRP2 in PCTEP2017062424, dated Sep. 6, 2018.

(Continued)

*Primary Examiner* — Patrick M. Buechner
(74) *Attorney, Agent, or Firm* — Greenberg Traurig, LLP

(57) ABSTRACT

A robust and ergonomic fluid dispenser (1) suitable for dispensing cosmetic compositions and comprising a cylindrical outer body, an upper section having a domed applicator surface, a cylindrical lower section that forms a protective cover for a refill cartridge (13), a rotatable actuator collar (4), an axially mobile pump housing (6) carrying a pump engine inside, the rotatable actuator collar (4) and axially mobile pump housing (6) interacting by means of a cam track on one and a cam follower on the other, the pump housing (6) being reversibly attached to the refill cartridge (13), the cam follower (7) on the pump housing (6) rising on rotation of the actuator collar (4) in a first direction and thereby lifting the pump housing (6) and the refill cartridge (13) to a raised position and actuating the pump engine, the cam follower (7) on the pump housing (6) falling on rotation
(Continued)

of the actuator collar (4) in a second direction to a rest position and thereby lowering the pump housing (6) and the refill cartridge (13).

14 Claims, 6 Drawing Sheets

(52) U.S. Cl.
CPC .... *B05B 11/3052* (2013.01); *A45D 2034/005* (2013.01); *B05B 11/0038* (2018.08); *B05B 11/3004* (2013.01); *B05B 11/3047* (2013.01)

(58) Field of Classification Search
CPC ..... B05B 11/3004; B05B 11/0038; B05B 11/3047
See application file for complete search history.

(56) References Cited

U.S. PATENT DOCUMENTS 5,152,425 A * 10/1992 Baudin ..... B05B 3/02 222/1
5,516,006 A * 5/1996 Meshberg ..... A61M 15/08 222/25
7,857,174 B2 12/2010 Michaux et al.
9,272,825 B2 * 3/2016 De Rosa ..... B65D 47/2087
9,681,731 B2 6/2017 Jo et al.
2006/0016833 A1 * 1/2006 Greiner-Perth ..... B05B 11/3076 222/383.1
2008/0023491 A1 * 1/2008 Rousselet ..... B65D 77/0493 222/256
2008/0023498 A1 * 1/2008 Bertin ..... B05B 11/0032 222/402.12
2008/0116232 A1 * 5/2008 Michaux ..... B65D 47/2012 222/507
2009/0071985 A1 * 3/2009 Ki ..... B05B 11/0027 222/309
2009/0120963 A1 * 5/2009 Bae ..... B05B 11/3069 222/153.13
2009/0127291 A1 5/2009 Corbellini
2009/0152303 A1 * 6/2009 Behar ..... B05B 11/3049 222/321.7
2011/0083666 A1 * 4/2011 Eberhard ..... B05B 11/308 128/200.23
2011/0315574 A1 * 12/2011 Lee ..... B05B 11/0078 206/219
2012/0024899 A1 * 2/2012 Michaux ..... B65D 83/22 222/153.13
2012/0085788 A1 * 4/2012 Lu ..... A45D 34/04 222/390
2012/0292344 A1 * 11/2012 Bertin ..... B65D 83/205 222/153.13
2013/0200107 A1 * 8/2013 Presche ..... B05B 11/3074 222/153.13
2013/0256338 A1 * 10/2013 Moreau ..... B65D 47/247 222/153.14
2014/0124538 A1 * 5/2014 Pouliaude ..... B05B 11/0008 222/153.09
2014/0231464 A1 8/2014 Cho
2017/0036226 A1 * 2/2017 Goettke ..... B05B 11/0029
2017/0348717 A1 * 12/2017 Puviland ..... A45D 34/00

FOREIGN PATENT DOCUMENTS

DE 102007007402 8/2007
WO WO02096571 12/2002

OTHER PUBLICATIONS

Search Report and Written Opinion in PCTEP2017062424, dated Sep. 12, 2017.
Seach Report and Written Opinion in EP16173336, dated Dec. 21, 2016.

* cited by examiner

FLUID DISPENSER

RELATED APPLICATIONS

The present application is a national phase filing under 35 USC 371 of International Application No. PCT/EP2017/062424, filed on May 23, 2017, which claims the priority of European Patent Application No. 16173336.5, filed on Jun. 7, 2016, the entire contents of which are hereby incorporated by reference.

The present invention is in the field of fluid dispensers, in particular fluid dispenser-applicators suitable for applying cosmetic compositions to the surface of the human body.

A variety of fluid dispensers has been disclosed in the prior art. Those most similar to the present invention are described below.

US 2014/0231464 (Samhwa Plastic Ind., 2014) discloses a rotary discharger for fluids comprising a rotating shoulder section associated with a moving cam section which moves up/down as the rotating shoulder section is rotated, the moving cam section being connected to a container for the fluid to be discharged. A pumping device is present within the moving cam section and interacts therewith.

U.S. Pat. No. 8,517,225 B2 (ELC Management, 2013) discloses manually operated personal care pump wherein a twisting motion is converted into a linear displacement that compresses a fluid in the accumulator.

EP 1,674,162 A1 (MegaPlast GmbH, 2006) discloses a dosing pump with rotating actuating means.

In a first aspect of the invention there is provided a fluid dispenser comprising a cylindrical outer body, an upper section that includes an outwardly domed applicator surface, a cylindrical lower section that forms a protective cover for a refill cartridge, a rotatable actuator collar, an axially mobile pump housing carrying a pump engine inside, the rotatable actuator collar and axially mobile pump housing interacting by means of a cam track on one and a cam follower on the other, the pump engine comprising an upper valve, a valve chamber, a piston seal and a lower valve, the pump housing being reversibly attached to the refill cartridge, the cam follower on the pump housing rising on rotation of the actuator collar in a first direction and thereby lifting the pump housing and the refill cartridge to a raised position and actuating the pump engine, the cam follower on the pump housing falling on rotation of the actuator collar in a second direction to a rest position and thereby lowering the pump housing and the refill cartridge.

In a second aspect of the invention there is provided a method of applying a cosmetic composition to the surface of the human body comprising the use of a fluid dispenser according to the first aspect of the invention.

In a third aspect of the invention there is provided a method of manufacture of a fluid dispenser according to the first aspect of the invention.

In a fourth aspect of the present invention, there is provided a kit of parts comprising a fluid dispenser (1) according to the first aspect of the invention and replacement refill cartridges (13) suitable for use therewith.

In the fourth aspect of the invention as described immediately above, the kit of parts preferably comprises directions as to how to replace the refill cartridge.

Herein, the "first direction" of rotation is opposite to the "second direction" of rotation. For example, the first direction may be clockwise and the second direction anticlockwise.

Herein, directions of rotation should be understood as viewed from above the dispenser.

Herein, orientation terms such as "horizontal/vertical" and "upper/lower" should be understood to refer to the dispenser and/or components thereof oriented in an upright manner with the applicator surface towards the top.

Dispensers of the present invention provide robust and ergonomic deliver of the fluid they contain within their refill cartridge. The refill cartridge is replaceable, allowing for repeated and hence efficient use of the other components of the dispenser, which in turn makes the robustness of those components and the overall design essential.

Dispensers of the present invention enable ergonomic delivery of fluids, in particular the delivery of cosmetic compositions to the surface of the human body.

The rotatable actuator collar and axially mobile pump housing, which interact by means of a cam track on one and a cam follower on the other, do so in a manner such that rotation of actuator collar in a first direction causes the raising of the pump housing and the associated refill cartridge and actuation of the pump engine. In addition, the interaction between the cam track and cam follower when the actuator collar is rotated in a second direction, counter to the first, results in the lowering of the pump housing and the associated refill cartridge, together with the refiling of the valve chamber of the pump engine from the refill cartridge.

In typical embodiments, actuation of the pump engine involves opening of the upper valve and depression of the piston seal thereby forcing fluid out of the valve chamber and onto the applicator surface via the connection pipe and lowering of the pump engine and refill cartridge involves refilling of the valve chamber of the pump engine, by the opening of the lower valve and the drawing of fluid out of the refill cartridge into the valve chamber under suction from the rising piston seal.

In preferred embodiments, the rotatable actuator collar bears the cam track and the axially mobile pump housing bears the cam follower. Typically, the cam track protrudes from the inner surface of the actuator collar and the cam follower protrudes from an outer surface of pump housing.

In preferred embodiments, the cam followers are rotationally immobile. In particularly preferred embodiments, there are two or more such cams followers, dispersed with radially equal spacing around the diameter of the axially mobile pump housing. In especially preferred embodiments, the cam followers protrude through vertical gaps or "yokes" in an inner chassis that links together other elements of the dispenser, notably upper and lower elements. Combinations of features as described above aid the robustness and structural integrity of the dispenser.

The pump engine comprises two valves, one at the top and one at the bottom. The upper valve is typically a piston valve. When the upper valve opens, the valve chamber of the pump engine is open to the connection pipe, which is located above it and is attached thereto. The connection pipe serves to allow transfer of fluid from pump valve chamber to the applicator surface.

Fluid is forced from the pump valve chamber and into the connection pump by action of the piston seal, which is depressed into the valve chamber whilst the upper valve of the pump engine is open. The "depression" of the piston seal into the valve chamber is only a relative term; in reality, the piston seal does not itself move downwards, instead the pump valve chamber is moved upwards during this phase of the pump operation, forcing fluid from it via interaction with the piston seal.

Actuation of the pump engine is achieved by rotation of the actuator collar in a first direction, together with the raising of the pump housing. In preferred embodiments, the connection pipe fits through an orifice in the centre of pump housing and is held axially immobile underneath the applicator surface. In particularly preferred embodiments, the upper valve for the pump engine is held axially immobile within the connection pipe (at its lower end), enabling it and the connection pipe to be actively involved in the pump engine actuation. In such embodiments, as the pump valve chamber is moved upwards by the pump housing, the axially immobile upper (piston) seal is pushed into the valve chamber simultaneous with or shortly before the piston seal is pushed into the valve chamber by the axially immobile connection pipe. In preferred embodiments as described in this paragraph, the upper valve is held axially immobile by the connection pipe.

Refilling of the pump engine from the refill cartridge is achieved by rotation of the actuator collar in a second direction, counter to the first, together with the lowering of the pump housing. During this phase of the pump engine cycle, the upper (piston) valve is closed and the lower valve is open. In preferred embodiments, as the pump housing is lowered a negative pressure is generated therein due to the upper (piston) seal pulling the piston seal outwards from the pump valve chamber. The negative pressure causes the opening of the lower valve of the pump engine and allows fluid from the refill cartridge (now at higher pressure) to enter the valve chamber. In particular preferred embodiments, the lower valve of the pump engine is a ball valve.

In preferred embodiments, the pump housing is lowered by a return spring, which is typically a torsion spring that forces rotation of the actuator collar in its second direction. This feature improves the ease of use of the dispenser.

The applicator surface is convex, that is to say, outwardly domed. This is particularly useful for the application of cosmetic compositions, in particular deodorant compositions to the axillae, where the ergonomics of delivery are thereby enhanced.

The actuator collar is located axially below the applicator surface and extends fully around the circumference of the dispenser. It is independent of the actuator surface and is rotatable independent of the actuator surface and the cylindrical outer body or portion thereof axially below it.

In preferred embodiments, rotation of the actuator collar in its first direction is limited by a stop mechanism, typically involving interacting between a rotation restrictor on the actuator collar to limit rotation in the first direction beyond a maximum extent.

A preferred additional feature of the present invention is an axially immobile chassis, typically located within the actuator collar and on the outside of the axially mobile pump housing. In particularly preferred embodiments, this chassis bears the stopper referred to in the paragraph immediately above on its inner surface. This stopper preferably interacts with a rotation restrictor on the actuator collar to limit rotation in the first direction beyond a maximum extent.

In preferred embodiments, rotation of the actuator collar in its second direction is brought about by a torsion spring when the user removes rotational torque forcing the actuator collar in its first direction. The torsion spring may be held between the pump housing and an element of the chassis referred to in the paragraph immediately above; in such embodiments, the torsion spring preferably functions to draw the pump housing back towards its original position when the user removes rotational torque forcing the actuator collar in its first direction.

The chassis, when present, is preferably firmly attached to the upper part of the dispenser and is more preferably firmly attached to upper part of the dispenser and the lower part of dispenser (which may also serve as a cartridge protector). This combination of features aiding the robustness and structural integrity of the dispenser.

The (lower) part of the dispenser which surrounds the refill cartridge and serves as a protector therefor is typically the major component of the outer body of the dispenser, i.e. comprising greater than 30%, preferably greater than 40% and more preferably greater than 50% of the total surface area thereof.

In preferred embodiments, the applicator surface has a (removable) protective cap designed to sit over it. Such caps may be fully removable or may be hinged so as to expose the applicator surface by pivoting away from the same.

In particularly preferred embodiments, the protective cap is reversibly held over the applicator surface and may be replaced and re-held over applicator surface following its removal. This may be achieved by any of the means known in the art, including interacting beads and recesses.

SPECIFIC EMBODIMENT

The features described with reference to the following specific embodiments may be considered preferred features of the generic description given above and/or may be incorporated independently into the subject matter as described in the following claims.

Each of the figures illustrate various features of the same specific embodiment. Please note that the drawings are not each to the same scale.

Figure 9:
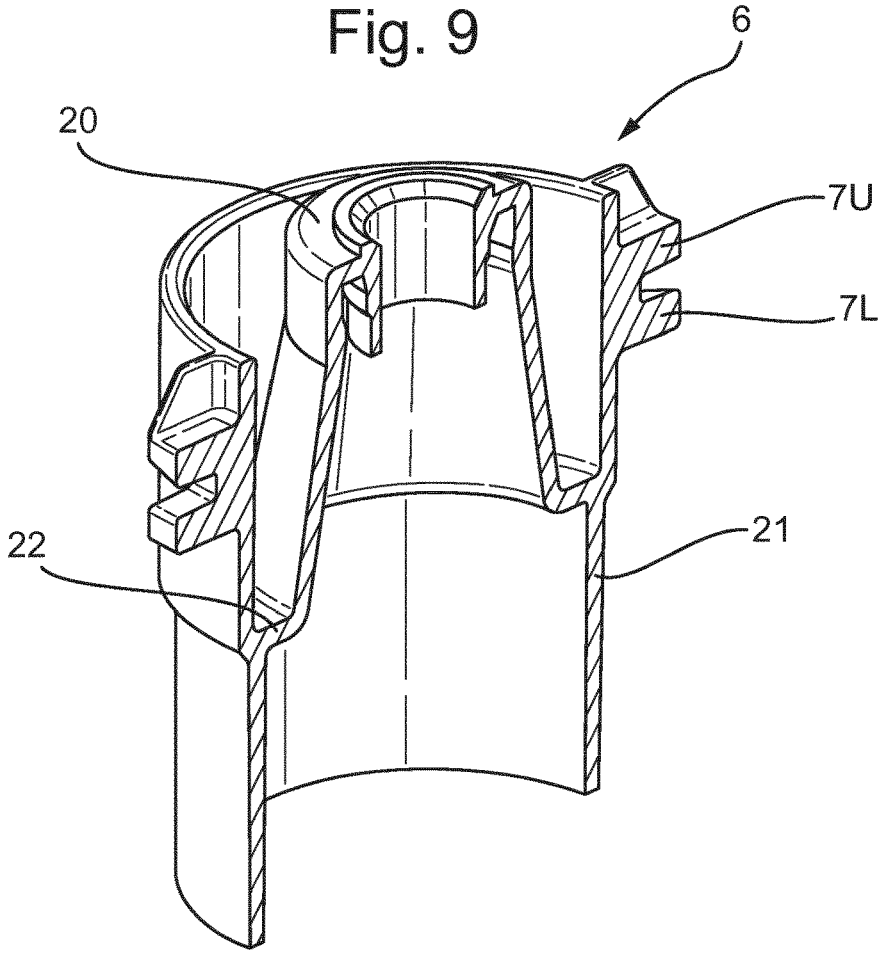

FIG. 9 further illustrates features of the axially mobile pump housing (6).

Figure 10:
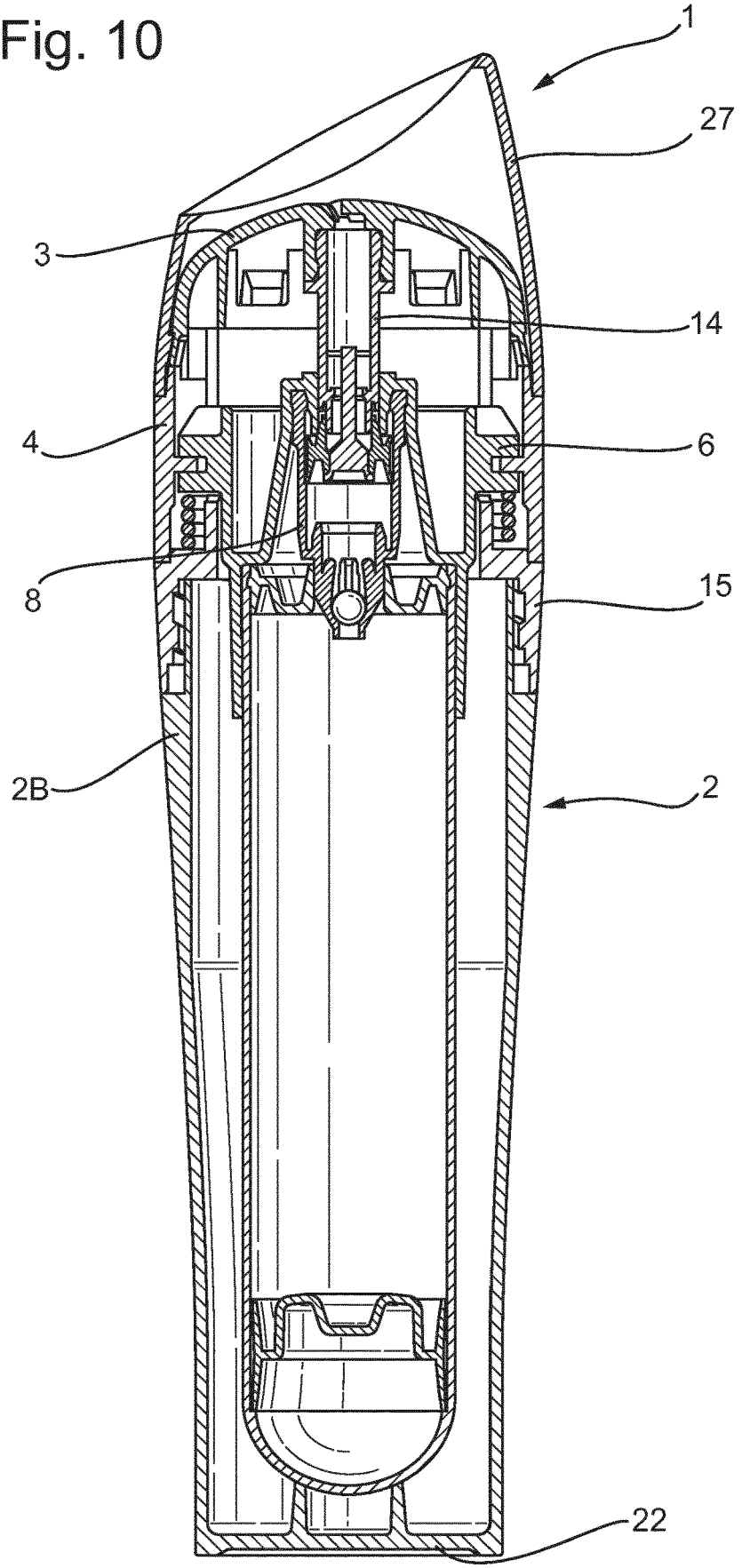

FIG. 10 is a cross-section through the specific embodiment with a removable protective cap (25) in place.

Figure 1:
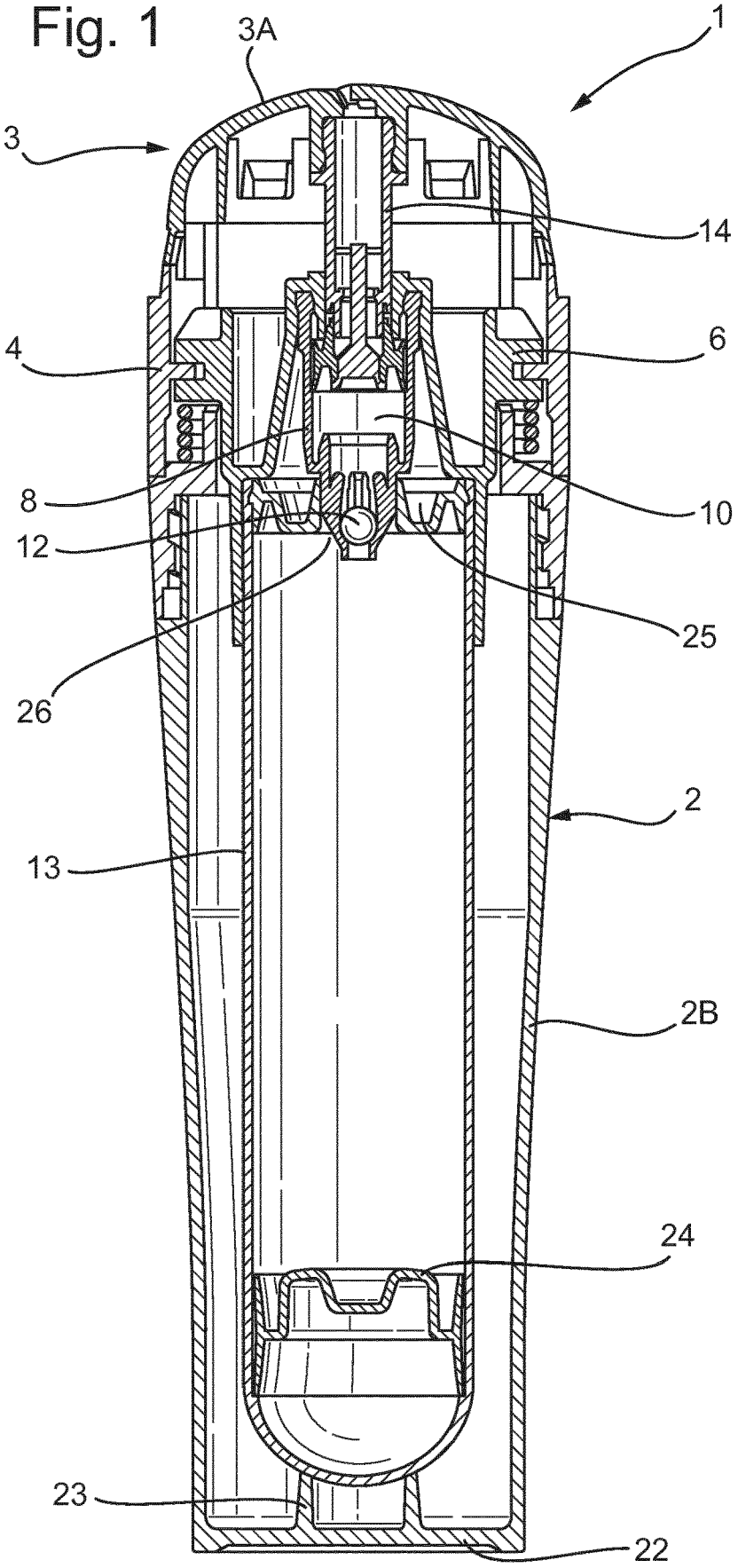
FIG. 1 is cross-section through the specific embodiment.
Figure 2:
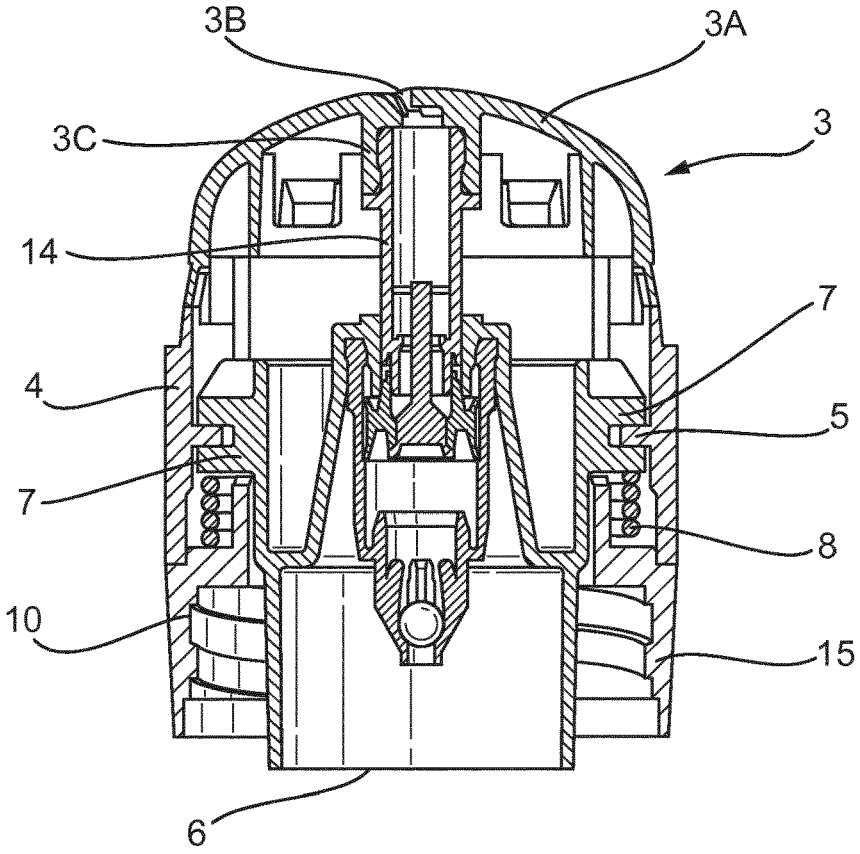
FIG. 2 is an enlarged cross-sectional view of components in the upper part of the specific embodiment.

Key features of the invention are illustrated in the embodiment of the invention shown in the figures. FIGS. 1 and 2 show a fluid dispenser (1) comprising a cylindrical outer body (2), the fluid dispenser comprising an upper section (3) that includes an outwardly domed applicator surface (3A) and a cylindrical lower section (2B) which forms a protective outer casing or "cartridge protector" for a refill cartridge (13).

The applicator surface (3A) defines an exit orifice (3B) for fluid exiting a pump valve chamber (10) via a connection pipe (14) (vide infra).

A rotatable actuator collar (4) is located axially below the upper section (3). The actuator collar (4) interacts with an axially mobile pump housing (6), interacting by means of a cam tracks (5) on the former and cam followers (7) on the latter.

Figure 3:
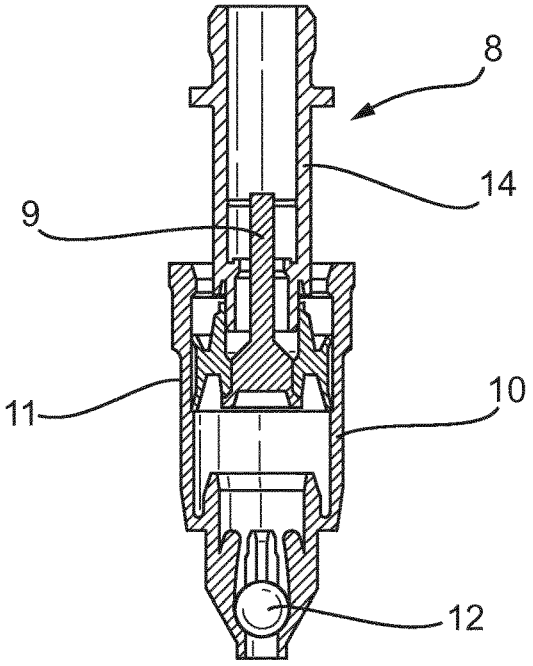
FIG. 3 is an enlarged cross-sectional view of components in the pump engine (8) and the associated connection pipe (14).

The axially mobile pump housing (6) holds within it a pump engine (8) which is shown in FIG. 3. The pump engine (8) comprises an upper valve (9), a valve chamber (10), a piston seal (11) and a lower valve (12). The upper valve (9) is a piston valve and seals against the piston seal (11) through which it passes at its centre. The lower valve (12) is a ball valve which is opened when the pressure in the valve chamber (10) is less than that the refill container (13) to which the pump engine (8) to which it is reversibly attached.

Connected to the upper (piston) valve (9) at its upper end is the connection pipe (14) which serves to allow passage of fluid from the valve chamber (10) to the applicator surface (3A) via the exit orifice (3B) when the pump engine (8) is actuated by rotation of the actuator collar (4). The connection pipe (14) is axially immobile due to its abutment against the inner surface of the upper section (3) where the top of the connection pipe (14) fits within a holding collar (3C).

Figure 4:
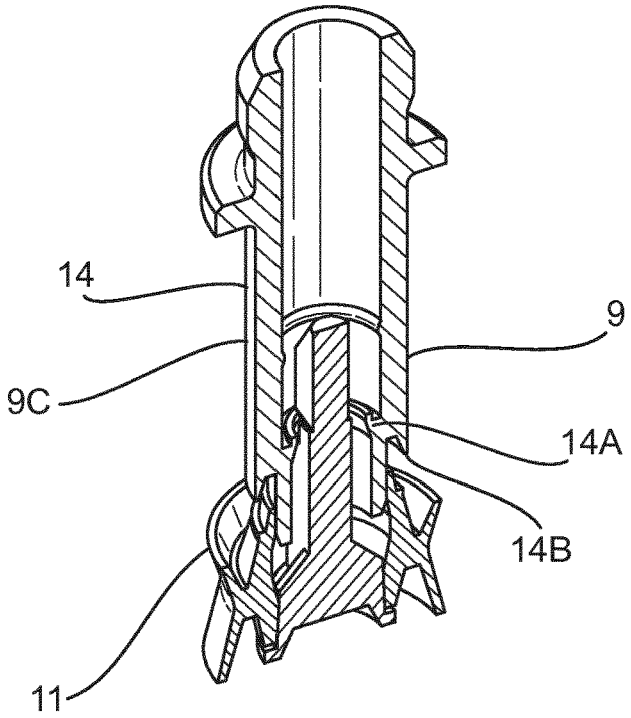
FIGS. 4 and 5 are sectional views of components of the pump engine (8) together with the associated connection pipe (14).
Figure 5:
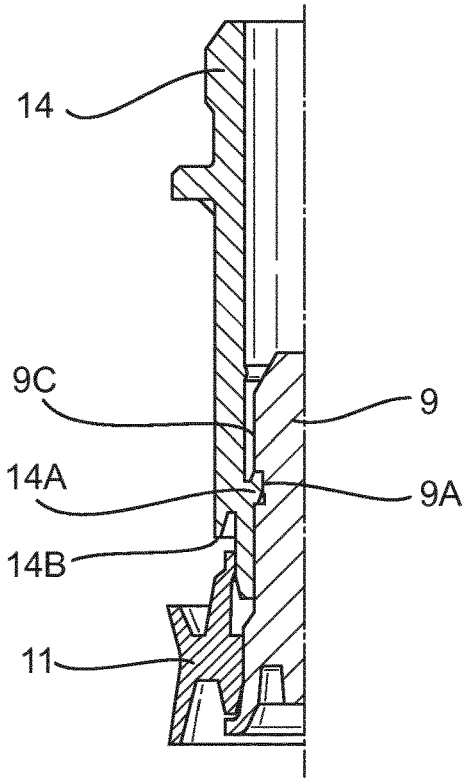

FIGS. 4 and 5 illustrate how the upper (piston) valve (9) is held axially immobile by the connection pipe (14), the connection pipe (14) having an annular projection (14A) that fits into recesses (9A) and (9B) (not illustrated) in diagonally opposed radial projections (9C) and (9D) (not illustrated) that extend substantially down the length of the upper valve (9). This enables the upper valve (9) to create an opening to the valve chamber (10) as the valve chamber (10) and piston seal (11) are raised against it. Shortly after the upper valve (9) opens the valve chamber (10) from above, projections (14B) from the outer surface of the connection pipe (14) start to press upon the piston seal (11) and force it into the valve chamber (10) as the latter is raised upwards against it. This results in the emptying of the valve chamber (10) through the connection pipe (14) as described above.

The actuator collar (4) results in actuation of the pump engine (8) as a result of the inward projecting cam track (5) from the actuation collar (3) interacting with two cam followers (7) present on the outer surface of the axially mobile pump housing (6).

Figure 6:
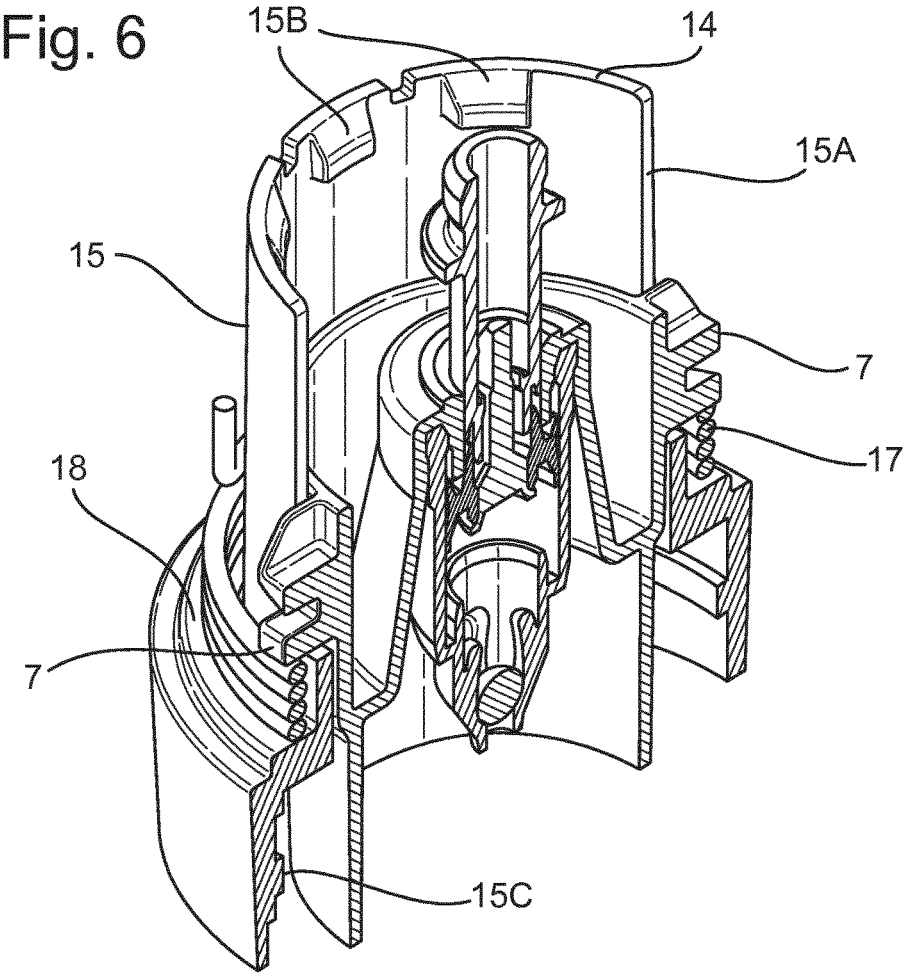
FIG. 6 is a skewed cross-sectional view of an inner chassis (15) together with components present therein and an associated torsion spring (17).

FIG. 6 illustrates how the cam followers (7) project through vertical gaps or "yokes" (15A) (shown in part) in an inner chassis (15) that links together the upper section (3) and the lower section (2B) of the dispenser (1). The yokes (15A) are located diagonally opposite one another. The cam followers (7) projecting from the pump housing (6) rise upwards within the yokes (15A) when the pump engine (8) is actuated and fall back downwards with the yokes (15A) when the pump engine (8) is refilling. The yokes (15A) restrict rotational movement of the pump housing (8) as a result of the cam followers protruding through them.

Figure 7:
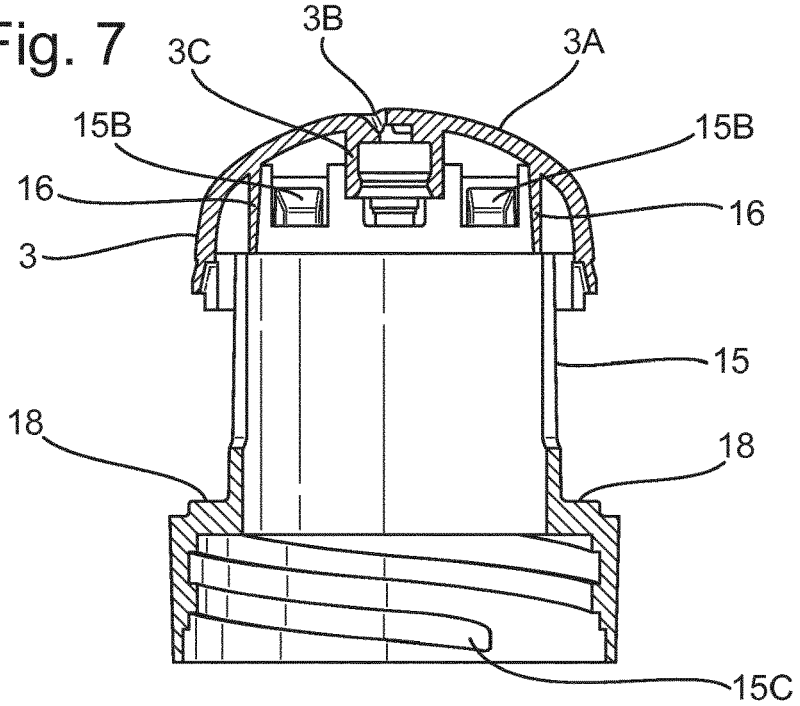
FIG. 7 is a cross-sectional view of the inner chassis (15) as illustrated in FIG. 6 together with the upper section (3) of the dispenser (1).

FIGS. 6 and 7 illustrate features of the binding of the upper (3) and lower (2B) sections of the dispenser (1) onto the chassis (15). The upper section (3) is firmly attached onto the chassis (15) by clips (15B) projecting inwardly from an annular surface of the latter into gaps in a vertical cylindrical wall (16) falling from the inner top surface of the upper section (3). The lower section (2B) of the dispenser (1) is firmly attached onto the chassis (15) by a screw thread (15C) on the former which screws onto a corresponding screw thread on the latter (not illustrated).

A torsion spring (17) exists between the inner chassis (15) and the axially mobile pump housing (6). This serves to return the pump housing (6) to its lowered position when torque is removed from the actuation collar (4). The torsion spring (17) sits between a horizontal annular shelf (18) protruding from the chassis (15) and lower surfaces of the cam followers (7) protruding from the pump housing (6).

In operation, torque is exerted on the actuator collar (4) forcing the pump housing upwards and the pump engine (8) to be actuated and product to be dispensed. When the torque on the actuator collar (4) is removed, the torsion spring (17) pulls the pump housing (6) back down towards its rest position, thereby refilling the pump valve chamber (10) (vide supra).

Figure 8:
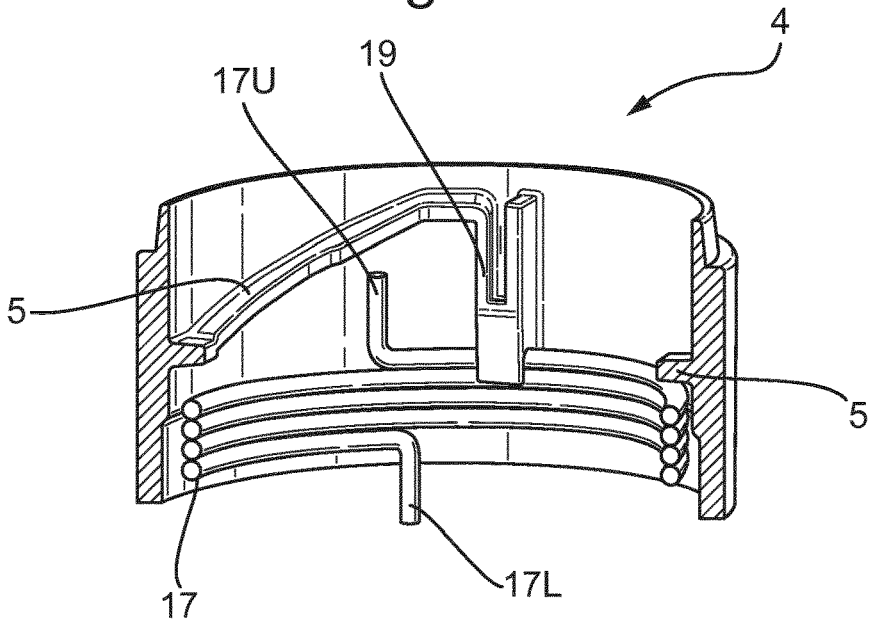
FIG. 8 illustrates the internal features of the actuator collar (4) and the associated torsion spring (17).

FIG. 8 shows details on the internal surface of the actuator collar (4). The cam tracks (5) (one illustrated in full and one only illustrated in cross-section at its lower end) rise around the inner surface of actuator collar (4) in a clockwise direction. Hence, rotation of the actuator collar in an anti-clockwise direction causes the axially mobile pump house (6) to rise.

Also illustrated in FIG. 8 is the torsion spring (17). The lower end (17L) of this spring is bent downwards and anchors into a hole (not illustrated) in the horizontal annular shelf (18) protruding from the chassis (15). Towards the upper end (17U) of the spring, it passes through a vertical projection (19) protruding from the inner surface of the actuator collar (4), through which it is able to slide, to a certain extent, when the actuator collar (4) is rotated. Sliding of the torsion spring (17) through the vertical projection (19) from the actuator collar (4) is restricted by its upper end (17U), which is bent upwards and abuts the anticlockwise wall of vertical projection (19) when anticlockwise rotation has proceeding somewhat.

The axially mobile pump housing (6) is illustrated by itself in FIG. 9. The pump housing (6) comprises an inner cylinder (20) that radial expands towards its lower end to form a frustoconical structure linking into an outer cylinder (21) via a narrow annular platform (22). The inner cylinder (20) holds the pump engine (8) within it and the lower part of the outer cylinder (21) reversibly holds the upper part of the refill cartridge (13) within it.

The pump housing (6) has two diagonally opposed cam followers (7) protruding from it (vide supra). Each of these cam followers (7) has an upper part (7U) which rides above the cam track (5) and a lower part (7L) which rides below the cam track (5). The lower parts (7L) of the cam tracks stop rotation of the actuator collar (4) when they reach the "anticlockwise" edge of the vertical projection (19) protruding from the inner surface of the actuator collar (4). This happens approximately 45° from the "rest" position.

Returning to FIG. 1, additional features not previously described include a base plate (22) that seals across the bottom of the cylindrical lower section (2B). Protruding upwards from this base plate (22) there is an inner cylindrical wall (23) that serves to support the bottom of the refill cartridge (13) when this is in its "rest" position".

Features of the refill cartridge (1) illustrated in FIG. 1 include a rubber septum (24), which rises up the refill cartridge (13) as its contents are removed via the pump engine (8). In addition, at the top of the refill cartridge (13) there is a top seal (25) defining an opening (26) in its centre through which the lower part of the pump engine (8) protrudes, enabling fluid passage between the refill cartridge (13) and the valve chamber (10) when the lower valve (12) is open. The lower part of the pump engine (8) forms a sealing fit in the opening (26) in the top seal (25) of the refill cartridge (13).

FIG. 10 is essentially the same as FIG. 1, but illustrates the presence of an optional protective cap (27).

The invention claimed is:

1. A fluid dispenser comprising a cylindrical outer body, an upper section that includes an outwardly domed applicator surface, a cylindrical lower section that forms a protective cover for a refill cartridge, a rotatable actuator collar, an axially mobile pump housing carrying a pump engine inside, the rotatable actuator collar and axially mobile pump housing interacting by means of a cam track on one and a cam follower on the other, the pump engine comprising an upper valve, a valve chamber, a piston seal and a lower valve, the pump housing being reversibly attached to the refill cartridge, the cam follower on the pump housing rising on rotation of the actuator collar in a first direction and thereby lifting the pump housing and the refill cartridge to a raised position and actuating the pump engine, the cam follower on the pump housing falling on rotation of the actuator collar in a second direction to a rest position and thereby lowering the pump housing and the refill cartridge, wherein the cam follower is rotationally immobile.

2. The fluid dispenser according to claim 1, wherein actuation of the pump engine involves opening of the upper valve and depression of the piston seal thereby forcing fluid out of the valve chamber and onto the applicator surface via a connection pipe and wherein lowering of the pump engine and refill cartridge involves refilling of the valve chamber of the pump engine, by the opening of the lower valve and the drawing of fluid out of the refill cartridge into the valve chamber under suction from the rising piston seal.

3. The fluid dispenser according to claim 1, wherein the rotatable actuator collar is located around the cylindrical outer body at a distance axially removed from the applicator surface.

4. The fluid dispenser according to claim 1, comprising a protective cap designed to sit over the applicator surface.

5. A method of applying a cosmetic composition to the surface of the human body comprising the use of a fluid dispenser according to claim 1.

6. A kit of parts comprising a fluid dispenser according to claim 1 and replacement refill cartridges suitable for use therewith.

7. The kit of parts according to claim 6, further comprising directions as to how to replace the refill cartridge.

8. The fluid dispenser according to claim 1, comprising an axially immobile inner chassis that links together the upper and lower sections of the dispenser.

9. The fluid dispenser according to claim 8, comprising a return spring for pulling the pump engine back from its raised position to its rest position.

10. The fluid dispenser according to claim 9, wherein the return spring is a torsion spring sitting between a horizontal annular shelf protruding from a chassis and lower surfaces of the cam followers protruding from the pump housing.

11. The fluid dispenser according to claim 8, comprising stop features configured to limit rotation of the actuator collar in its first direction.

12. The fluid dispenser according to claim 11, wherein one of the stop features is part of the cam follower and one of the stop features is located on an inner surface of the actuator collar.

13. The fluid dispenser according to claim 12, wherein there are two or more rotationally immobile cam followers, dispersed with radially equal spacing around a diameter of the axially mobile pump housing.

14. The fluid dispenser according to claim 13, wherein the cam followers protrude through vertical gaps or "yokes" in an inner chassis.

* * * * *